United States Patent [19]

Hoshino

[11] Patent Number: 4,693,160

[45] Date of Patent: Sep. 15, 1987

[54] MECHANISM FOR TENSIONING STRINGS OF HEADLESS GUITARS

[75] Inventor: Yoshiki Hoshino, Owari Asahi, Japan

[73] Assignee: Hoshino Gakki Co., Ltd., Japan

[21] Appl. No.: 828,394

[22] Filed: Feb. 11, 1986

[30] Foreign Application Priority Data

Apr. 11, 1985 [JP] Japan ..... 60-053954[U]

[51] Int. Cl.[4] ..... G10D 3/14

[52] U.S. Cl. ..... 84/306; 84/267; 84/313

[58] Field of Search ..... 84/297–299, 84/304–307, 312–313, 200, 204, 207

[56] References Cited

U.S. PATENT DOCUMENTS

| | | | |
|---|---|---|---|
| 363,720 | 5/1887 | Brett | 84/207 |
| 3,431,807 | 3/1969 | Thompson | 84/306 |
| 3,452,635 | 7/1969 | Sebers et al. | 84/312 P |
| 4,512,232 | 4/1985 | Schaller | 84/313 |
| 4,549,460 | 10/1985 | Gressett et al. | 84/298 |
| 4,608,905 | 9/1986 | Takabayashi | 84/313 |

FOREIGN PATENT DOCUMENTS

| | | | |
|---|---|---|---|
| 3526928 | 4/1986 | Fed. Rep. of Germany | 84/313 |

*Primary Examiner*—Lawrence R. Franklin

[57] ABSTRACT

Means for tensioning the strings of a guitar includes a rotary adjusting member, a manually operable control member, and a worm gear type drive means connecting the control member to drive the adjusting member. The adjusting member includes a portion for holding the tail end of a string that is supported on a string tensioning portion of the adjusting member. The string tensioning portion includes a convex surface that is eccentric with respect to the axis about which the adjusting member rotates and is constructed so that there is a non-linear relationship between incremental movements of the adjusting member and tensioning of the string, with this relationship being such that the rate of string tensioning decreases as the magnitude of string tension increases.

11 Claims, 6 Drawing Figures

MECHANISM FOR TENSIONING STRINGS OF HEADLESS GUITARS

BACKGROUND OF THE INVENTION

This invention relates to guitars in general and more particularly relates to string tensioning means for so-called headless guitars.

In guitars, adjustments of string tension is generally carried out by using an adjustment screw that is mounted on the side of the guitar head, and such adjustment screw has been used only for secondary or fine tuning adjustment. Recently, so-called headless guitars have become popular. In such guitars, adjustment of string tension is carried out by screws on the side of the tail piece.

SUMMARY OF THE INVENTION

In accordance with the instant invention, there is provided a novel improved tail piece mounted mechanism for adjusting string tension, both fine and coarse. This achieved by providing an individual tensioning means for each string, such tensioning means including a rotary adjusting member having a string holding portion and a string tensioning portion. The latter includes a convex surface which supports the string and is formed so as to be eccentric with respect to the pivot for the adjusting member and disposed so that upon rotation of the adjusting member, the rate of string tensioning decreases as the magnitude of string tension increases.

Drive means for rotating the adjusting member comprises a worm that is rotated by a control member and is in driving mesh with a worm gear mounted to the adjusting member. The adjusting member rotational axis coincides with the rotational axis for the worm gear.

Accordingly, the primary object of the instant invention is to provide novel improved means for tensioning the strings of a so-called headless guitar.

Another object is to provide string tensioning means of this type that achieves both coarse and fine tensioning adjustments.

Still another object is to provide string tensioning means of this type of which there is a rotary adjusting member that is driven by a worm gear drive.

A further object is to provide string tensioning means of this type in which there is a rotary adjusting member that includes a convex string supporting surface which is eccentric with respect to the rotational axis of the adjusting member.

BRIEF DESCRIPTION OF THE DRAWINGS

These objects as well as other objects of this invention shall become readily apparent after reading the following description of the accompanying drawings in which.

DETAILED DESCRIPTION OF THE PREFERRED EMBODIMENT

Figure 1:
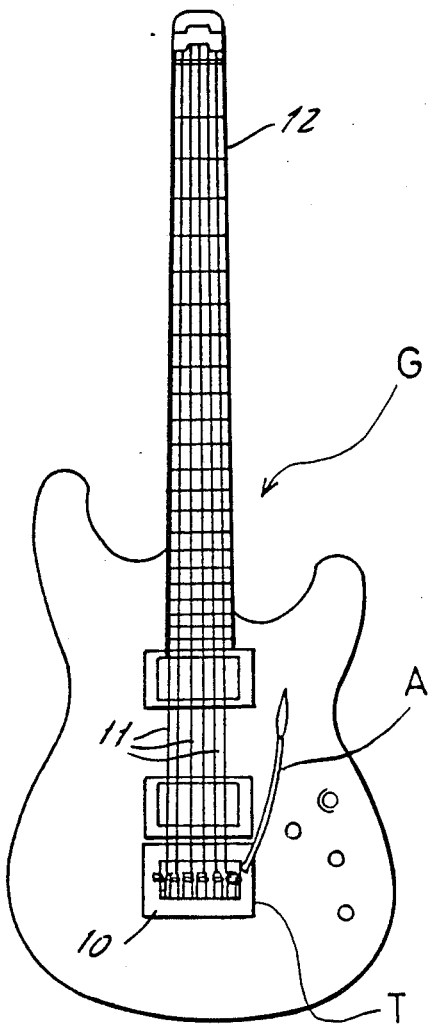
FIG. 1 is a front elevation of a so-called headless guitar.
Figure 2:
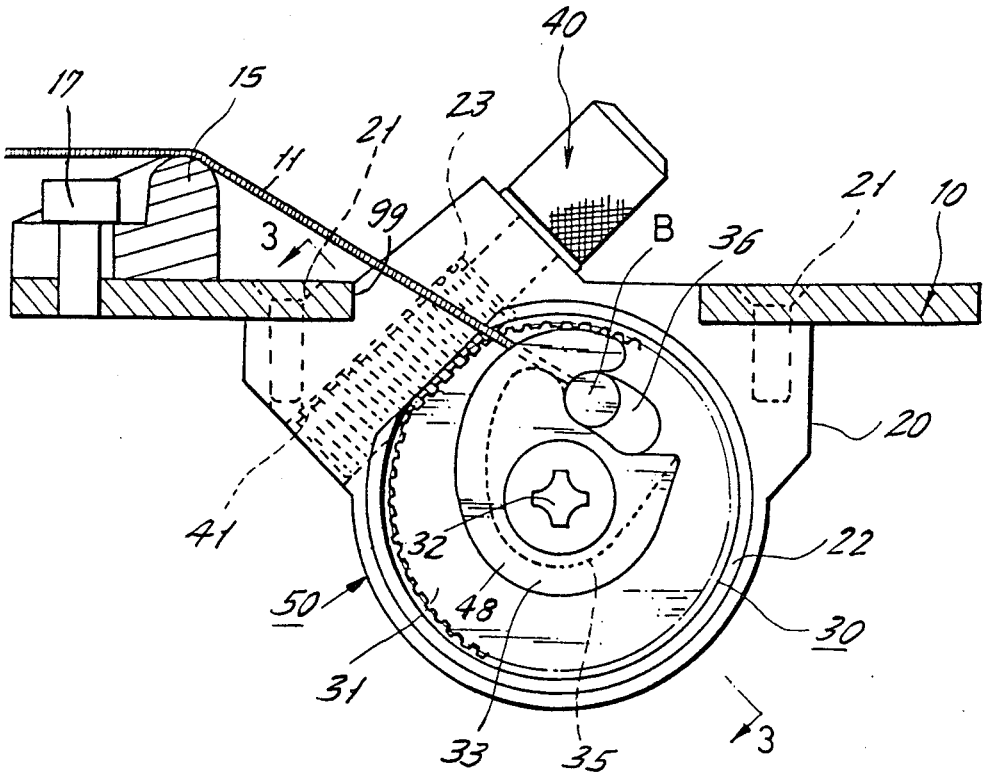
FIG. 2 is a cross-section through the tail piece of the guitar in FIG. 1 taken in a plane parallel to the strings, and illustrating string tensioning means constructed in accordance with the instant invention.

Now referring to the figures wherein headless guitar G shown in FIG. 1 includes tail piece T and tremolo arm A. A plurality of elongated strings 11 extend from tail piece T to the free end of elongated neck 12. String tensioning means 50 (FIG. 2), constructed in accordance with teachings of the instant invention is mounted on base plate 10 by two screws 21 which engage tensioning means housing 20. For the most part, housing 20 is disposed behind base plate 10 with a minor portion of housing 20 extending forward through base plate aperture 99. In the vicinity of aperture 99, strings 11 rest against the forward surface of saddle 15 that is adjustably mounted on the forward surface of base plate 10 and held in adjusted position by set screw 17.

Housing 20 defines shallow chamber 22 which has one open side and is of circular cross-section. Gear section 19 of rotary adjusting member 30 is disposed within chamber 22. Member 30 is freely mounted for rotation on the reduced diameter central portion 18 of pivot pin 32 having threaded end 16 that is held within a threaded bore of housing 20. Gear 19 is disposed within bore 23 of housing 20 and is threadably engaged by worm 41. Disposed outside of housing 20 and secured to one end of worm 23 is control member 40 that is manually operable from in front of base plate 10. Rotation of control member 40 is transmitted through worm 41 and gear 19 to rotate adjusting member 30 about pivot 32.

Figure 4:
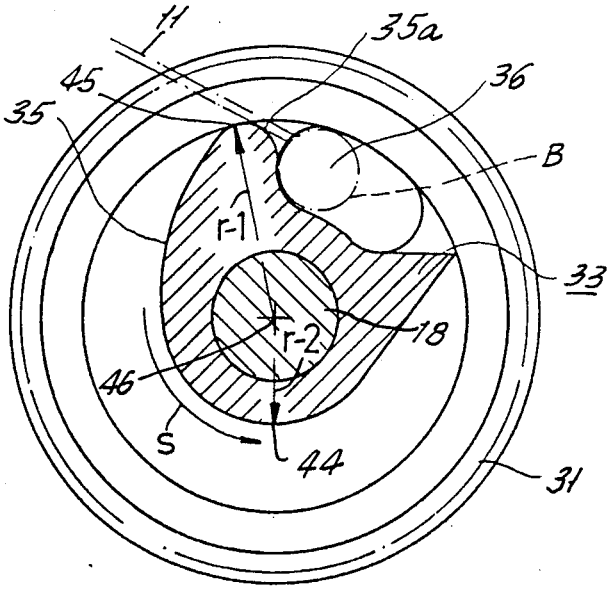
FIG. 4 is an enlarged side elevation of the rotary adjusting member with the string winding or tensioning portion sectioned.
Figure 5:
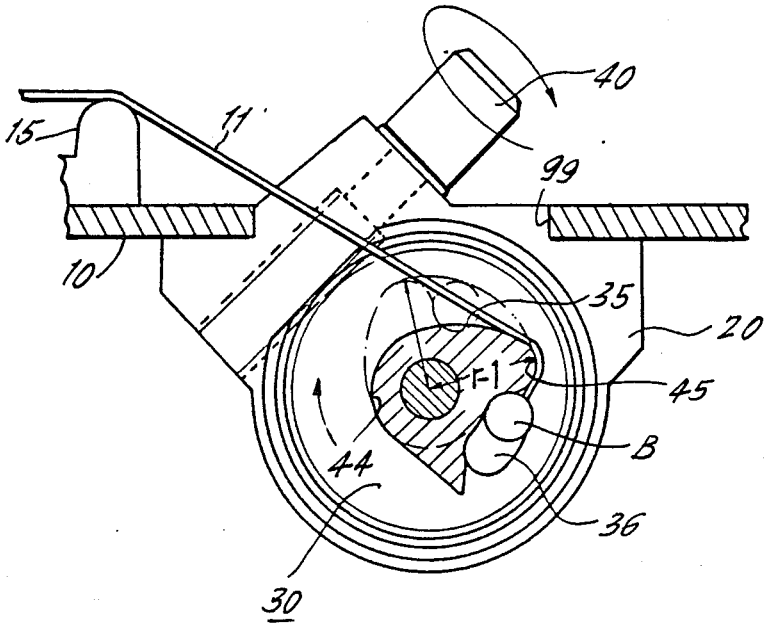
FIG. 5 is a fragmentary portion of FIG. 2 showing the adjusting member as string tensioning commences.
Figure 6:
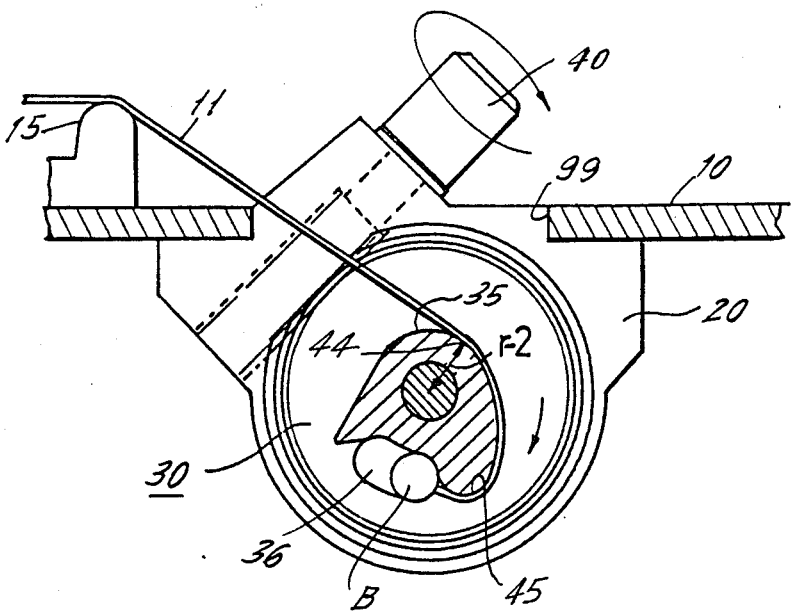
FIG. 6 is a view similar to FIG. 5 with the adjusting member shown at or near a final tensioning position.

Adjusting member 30 also includes string holding portion 36 and string tensioning portion 33. The latter includes convex string winding surface 35 which supports string 11 having ball B at its tail end. Ball B is captured by holding portion 36. Convex string winding surface 35 is at the bottom of string guiding groove 48 and is eccentric with respect to pivot axis 16 defined by pin 32. That is, the portion or point 45 of convex surface 35 adjacent string holding portion 36 is spaced from axis 46 by distance r-1. Moving in the rolling-up direction S (FIG. 4) along surface 35 from point 45, the spacing between points on surface 35 and axis 16 diminishes gradually until surface point 44 which is spaced by a distance r-2 from axis 46. Because of this eccentric positioning of convex surface 35, as adjusting member 30 is rotated clockwise from its initial tensioning position of FIG. 5 where string 11 is supported primarily in the region 45 of surface 35, continued rotation of adjusting member 30 to the position of FIG. 6 brings point 44 of surface 35 into position for supporting string 11. With this construction, for a given angular movement of adjusting member 30 in the clockwise or tensioning direction, the rate at which string 11 is tensioned will decrease.

Figure 3:
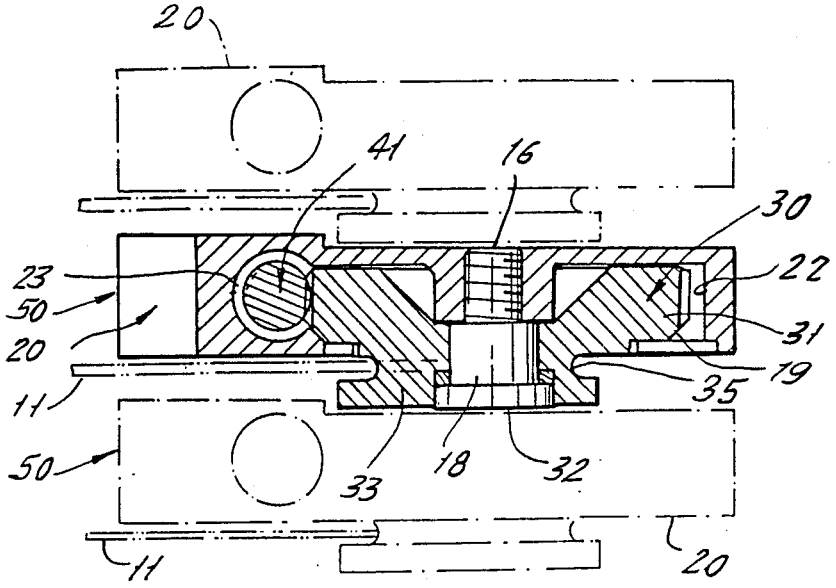
FIG. 3 is a cross-section taken through line 3—3 of FIG. 2 looking in the direction of arrows 3—3.

It should now be obvious to those skilled in the art that an individual tensioning means 50 is provided for each string 11 and, as seen in FIG. 3, housings 20 for these adjusting means are positioned in a side-by-side row, and convex surface 35 is outside of housing 20 adjacent the open side of chamber 22.

Although the present invention has been described in connection with a plurality of preferred embodiments thereof, many other variations and modifications will now become apparent to those skilled in the art. It is preferred, therefore, that the present invention be limited not by the specific disclosure herein, but only by the appended claims.

What is claimed is:

1. String tensioning means for a musical instrument such as a guitar, said string tensioning means including:

an adjusting member, a control member and drive means interposed between said control member and said adjusting member for moving the latter by operating said control member;

said adjusting member including a holding portion for grasping a string at a first end thereof;

said adjusting member also including a tensioning portion which supports a string section adjacent a string first end that is being grasped by said holding portion; and said string tensioning portion being operatively constructed so that for a given degree of operation for said control member, as magnitude string tension increases, rate of string tensioning decreases.

2. String tensioning means as set forth in claim 1 in which the drive means comprises worm-type gearing.

3. String tensioning means as set forth in claim 1, also including means defining an axis about which said adjusting member is rotatably mounted.

4. String tensioning means as set forth in claim 3 in which the string tensioning section includes a string supporting convex surface.

5. String tensioning means as set forth in claim 4 in which spacing between said axis and points on said convex surface decreases as distance between said points and said holding portion increases in a rolling-up direction.

6. String tensioning means as set forth in claim 3 in which the drive means comprises worm-type gearing including a gear and a worm in driving engagement with said gear;

said worm being operatively connected to said control member for rotation thereby; and said gear being operatively connected to said adjusting member.

7. String tensioning means as set forth in claim 6 in which said gear is mounted for rotation about said axis.

8. String tensioning means as set forth in claim 7, also including a housing defining a chamber wherein said gear is disposed; and said means defining said axis being mounted to said housing.

9. String tensioning means as set forth in claim 8 in which the string tensioning section includes a string supporting convex surface.

10. String tensioning means as set forth in claim 9 in which spacing between said axis and points on said convex surface decreases as distance between said points and said holding portion increases in a rolling-up direction.

11. String tensioning means for a musical instrument such as a guitar, said string tensioning means including:

an adjusting member, a control member, and drive means interposed between said control member and said adjusting member for moving the latter by operating said control member; said adjusting member including a holding portion for grasping a string at a first end thereof;

said adjusting member also including a tensioning portion which supports a string section adjacent a string first end that is being grasped by said holding portion;

a housing on which said adjusting member is movably mounted;

a base plate to which said housing is secured and having a front surface behind which said adjusting member is disposed;

said control member being disposed for operation from in front of said base plate;

said drive means comprising worm-type gearing including a gear and a worm in driving engagement with said gear;

means on said housing defining a rotational axis for said adjusting member and said gear;

said housing defining a chamber wherein said gear is disposed; said housing being provided with a wall at one side thereof and an opening at its opposite side;

said string tensioning section being disposed outside of said chamber in the vicinity of said opposite side;

said string tensioning section including a string supporting convex surface; and the spacing between said axis and points on said convex surface decreasing as the distance between said points and said holding portion increases in a rolling-up direction along said convex surface.

* * * * *